United States Patent [19]

Sato et al.

[11] Patent Number: 4,930,713

[45] Date of Patent: Jun. 5, 1990

[54] MILL ROLL STAND

[75] Inventors: Hiroshi Sato; Eiichi Shimizu, both of Hiroshima, Japan

[73] Assignee: Mitsubishi Jukogyo Kabushiki Kaisha, Tokyo, Japan

[21] Appl. No.: 321,872

[22] Filed: Mar. 10, 1989

[51] Int. Cl.[5] ..... B65H 16/06; B65H 19/30

[52] U.S. Cl. ..... 242/58.6; 74/103; 242/68.4

[58] Field of Search ..... 242/58, 58.6, 68, 68.4; 74/102, 103

[56] References Cited

U.S. PATENT DOCUMENTS

| | | | |
|---|---|---|---|
| 2,405,637 | 8/1946 | Behrens | 242/58.6 |
| 3,321,147 | 5/1967 | Martin | 242/58.6 |
| 4,586,673 | 5/1986 | Tokuno et al. | 242/58.6 |
| 4,706,905 | 11/1987 | Torres | 242/58.6 |

FOREIGN PATENT DOCUMENTS

| | | | |
|---|---|---|---|
| 10901 | 5/1980 | European Pat. Off. | 242/58.6 |
| 8629994 | 6/1987 | Fed. Rep. of Germany . | |

OTHER PUBLICATIONS

Technica; No. 24, 1983; Zurich Ch; p. 2087 Kurt Haine: "Flexible Handhabungsgetriebe mit zwel Linearantrieben".

*Primary Examiner*—Joseph J. Hail, III

*Attorney, Agent, or Firm*—Bernard, Rothwell & Brown

[57] ABSTRACT

The known mill roll stand in a feeding apparatus of a rolled sheet of the type including at least one pair of arms having rolling centers at their tip ends and constructed so as to be swingable about an arm shaft at their base ends and so as to be movable along the arm shaft to approach to or separate from each other, is improved so that when the rolling centers are raised by swinging up the arms so as to meet with sheet rolls having different roll diameters, the rolling centers may be raised along a vertical straight line locus rather than an arc-shaped locus. The improvements reside in that the opposite ends of the arm shaft are eccentrically and pivotably supported from rotary supports on a frame of the mill roll stand, and that there is provided converter mechanism for converting the swinging locus of the rolling center into a locus along a vertical straight line.

1 Claim, 2 Drawing Sheets

MILL ROLL STAND

BACKGROUND OF THE INVENTION:

1. Field of the Invention:

The present invention relates to a mill roll stand of an unwinding apparatus for successively feeding a necessary amount of rolled sheet (raw paper sheet) while holding the roll at its axis in a corrugate machine, a rotary press and the like, and more particularly to an adjustable device for an arm shaft position of the mill roll stand.

2. Description of the Prior Art:

One example of the mill roll stand in the prior art is schematically shown in FIGS. 4 and 5. As shown in these figures, principal constituent elements of the mill roll stand are main body frames 17, a pair of arms (support arms) 1, an arm elevator 18, a horizontal arm mover 19 and rolling centers 14, and besides the mill roll stand comprises a manipulating unit, a control unit, drive units for the respective members and the like, which are omitted from illustration.

Explaining now the mill roll stand in the prior art in more detail, by way of example, in connection to a production line of a corrugated cardboard sheet, main body frames 17 are fixedly installed at predetermined positions on a floor of the same production line, and on these main body frames 17 are provided a pair of arms 1 in an opposed relation to each other, which arms hold the rolling centers 14 at their tip ends, and which arms are adapted to slide horizontally as driven by the horizontal arm mover 19 and to swing about an arm shaft 2 at their base ends as driven by the arm elevator 18. These arms are mounted two pairs as aligned back and forth in the direction of feeding the sheet.

The arms 1 are mounted on arm shafts 2 via sliding keys not shown, each of the arm shafts 2 has its opposite ends rotatably supported from left and right frames 7, 7 via bearings 3, 3, and the arm elevator 18 has such structure that the rolling centers 14 at the tip ends of the arms 1 can be elevated and lowered as swung up and down by swinging a lever 21 fixedly secured to the arm shaft 2 by means of a cylinder 22 connected to the other end of the lever 21.

Next, explanation will be made briefly with respect to loading of a rolled sheet (raw paper sheet) 16.

A rolled sheet 16 carried in from the outside by means of a roll conveyor 15 and placed at a predetermined position is loaded through the following procedure.

The rolling centers 14 held by the arms 1 are rotationally lowered by the cylinder 22 under the horizontally separated condition and stopped at the position aligning in height with the center of the rolled sheet 16.

In response to a next signal sent from the control unit not shown, the arms 1 would slide along the arm shaft 2 so as to approach to each other as driven by the arm horizontal mover 19, and the rolled sheet 16 has its center core pipe portion pinched by the rolling centers 14. Subsequently, the rolled sheet 16 is raised up to a predetermined height by the action of the cylinder 22, and thus setting of the mill roll stand has been completed.

On the other hand, on the other pair of arms 1 provided on the opposite side is also loaded a rolled sheet 16 through a similar procedure to that described above, and it is made to stand by as a spare rolled sheet so that as soon as the rolled sheet 16 being supplied has been used up the rolled sheet in a standby state may be spliced to the end of the consumed rolled sheet to continue the production in the subsequent stage. In this way, by alternately splicing the rolled sheets 16 loaded on the two sets of arms 1, respectively, as pinched thereby, it becomes possible to continuously produce a corrugated cardboard sheet. Exchange of rolled sheets as a result of order change or consumption of a rolled sheet can be carried out by proceeding the aforementioned procedure of loading.

However, in the mill roll stand in the prior art, as shown in FIGS. 4 and 5, the opposite ends of each arm shaft 2 are pivotably supported via bearings 3 at fixed positions on the side surfaces of the frames, hence the rolling centers 14 at the tip ends of the arm 1 which swings about the arm shaft 2 would pass along a circulararc-shaped locus, and therefore, the mill roll stand had a structural defect that during ascent and descent, a horizontal distance S of the rolling center 14 from the center of the machine would vary. Accordingly, the phenomena that the axis of the rolling center 14 would deviate greatly in the horizontal direction from the center of the rolled sheet 16 depending upon the diameter of the rolled sheet 16, may possibly happen.

In FIG. 4, distances represented by $P_1$ and $P_2$, respectively, are the possible deviations in the horizontal direction of the axis of the rolling centers 14, which would vary depending upon the diameter of the rolled sheet 16. By the way, with regard to the diameter of the rolled sheet 16, rolled sheets having various sizes between 330 mm and 1540 mm in diameter are used.

As described above, in the prior art since the arms swing up and down about the arm shaft having its opposite ends pivotably supported via the bearings fixedly mounted to the side surfaces of the left and right frames, the locus of the rolling center at the tip end of the arm would depict a circular arc.

Whereas, the center axis of the rolled sheet carried in from the outside by means of a roller conveyor is always positioned on the center vertical plane of the roller conveyor. Accordingly, between the axis of the rolling centers and the center axis of the rolled sheet is produced a deviation indicated by $P_1$ or $P_2$ in FIG. 4 depending upon the diameter of the rolled sheet.

Due to the above-described structural defects, in the prior art it would possibly happen that upon loading a rolled sheet, it is forcibly displaced in the direction of the horizontal deviation by making use of tapered surfaces of the rolling centers, and upon exchange of rolled sheets as a result of order change or the like, the rolled sheet is released from the rolling centers, then it is displaced to rest on the roller conveyor, and thereafter a new rolled sheet is loaded in the abovedescribed manner. However, such forcible operations would not only result in damage of the paper sheet and the core tube portion of the rolled sheet as well as faults of the machine, but also become a bar against automation, and furthermore they serve as a great cause for degrading safety of the work.

SUMMARY OF THE INVENTION

It is therefore one object of the present invention to provide a novel mill roll stand which is free from the above-described shortcoming in the prior art and which includes a newly developed mechanism for making an axis of rolling centers always align with a center axis of a rolled sheet even if the diameter of the rolled sheet is varied.

In order to achieve the aforementioned object, according to one feature of the present invention, there is provided a mill roll stand in a feeding apparatus of a rolled sheet, which includes at least one pair of arms having rolling centers at their tip ends and constructed so as to be swingable about an arm shaft at their base ends and so as to be movable along the arm shaft to approach to or separate from each other, and in which the opposite ends of the arm shaft eccentrically and pivotably supported from rotary supports on a frame of the mill roll stand and there is provided converter means for converting the swinging locus of the rolling center into a locus along a vertical straight line.

In more particular, the structure is such that the opposite ends of the arm shaft which serves as a pivot when the arms holding a rolled sheet therebetween are raised or lowered, are pivotably supported from a frame via eccentric bearings, or pivotably supported from an eccentric plate and a shaft of the eccentric plate is in turn pivotably supported from a frame, and the position of the arm shaft can be variably set by rotating the eccentric bearing or the eccentric plate. Furthermore, in order to offset the deviation of the position of the rolling center at the tip end of the arm in the horizontal direction resulted from the arc-shaped locus of the rolling center, there is provided an additional mechanism for displacing the arm shaft horizontally in the opposite direction to the deviation by the amount of the horizontal deviation according to a predetermined calculation formula.

According to the present invention, since the deviation of the position of the rolling center in the horizontal direction resulted from the arc-shaped locus of the rolling center is offset by the compensative movement of the arm shaft about which the arm swings, the rolling center can be moved along a vertical line passing through the center line of the conveyor. Therefore, regardless of the diameter of the rolled sheet, it becomes possible to make the center axes of the rolled sheet and the rolling centers perfectly align with each other.

The above-mentioned and other objects, features and advantages of the present invention will become more apparent by reference to the following description of one preferred embodiment of the present invention taken in conjunction with the accompanying drawings.

DESCRIPTION OF THE PREFERRED EMBODIMENT

Figure 1:
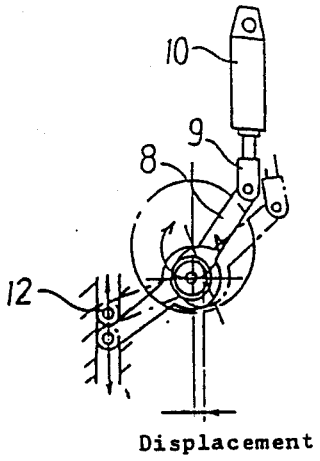
FIG. 1 is a side view showing one preferred embodiment of an arm support portion in a mill roll stand according to the present invention.
Figure 4:
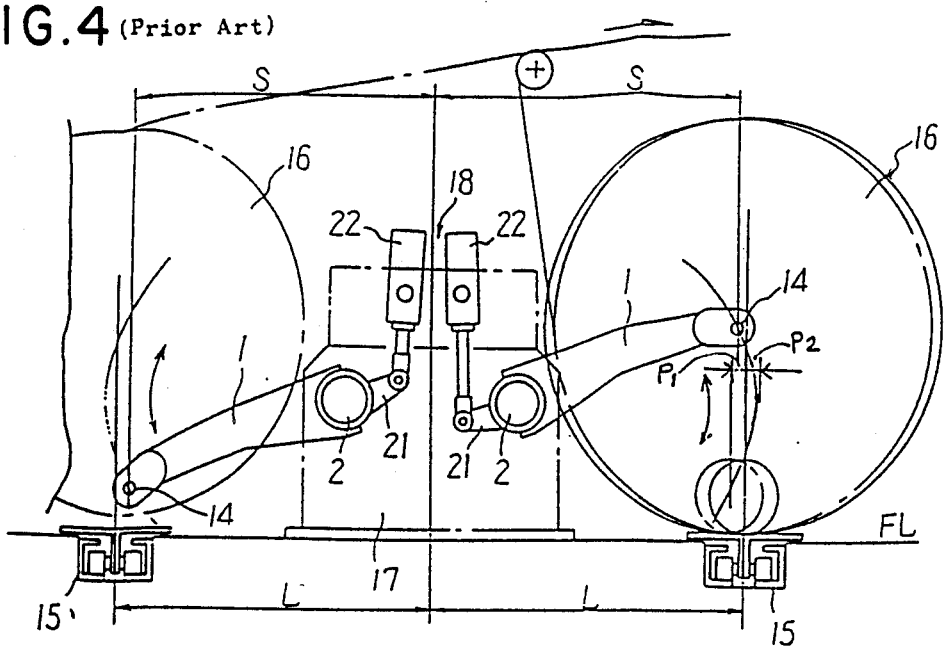
FIG.4 (Prior Art)
FIG. 4 is a schematic side view showing a mill roll stand in the prior art for explaining technical problems involved in the mill roll stand.
Figure 5:
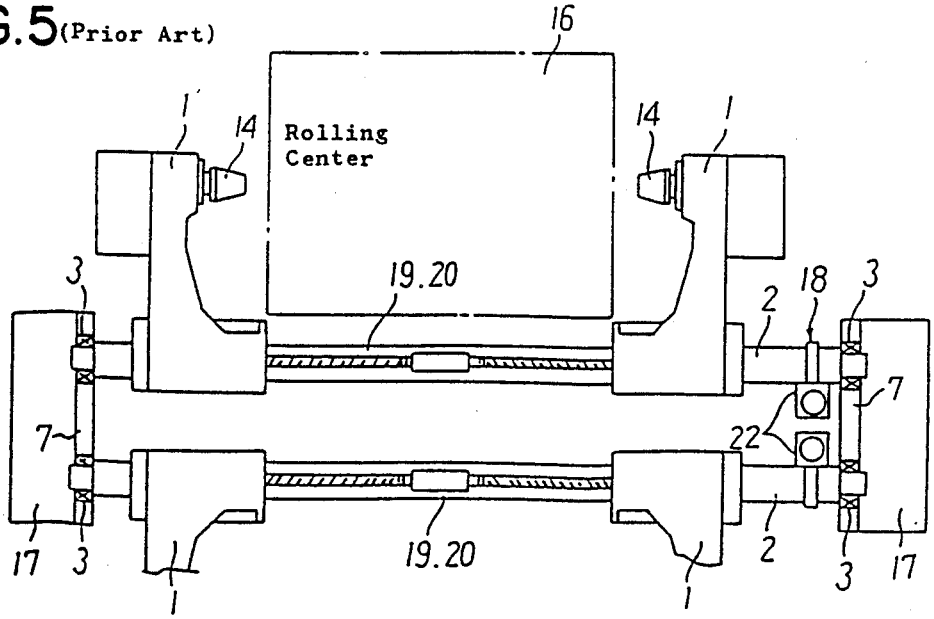
FIG.5 (Prior Art)
FIG. 5 is a schematic plan view of the same mill roll stand.

In the following, description will be made on one representative preferred embodiment of the present invention with reference to FIGS. 1 to 3, which illustrate the construction and function of an arm support portion in a mill roll stand. The general overall construction of the mill roll stand is similar to that shown in FIGS. 4 and 5, and with respect to a general function of the mill roll stand per se, it is also similar to that described above in connection to the mill roll stand in the prior art.

Figure 2:
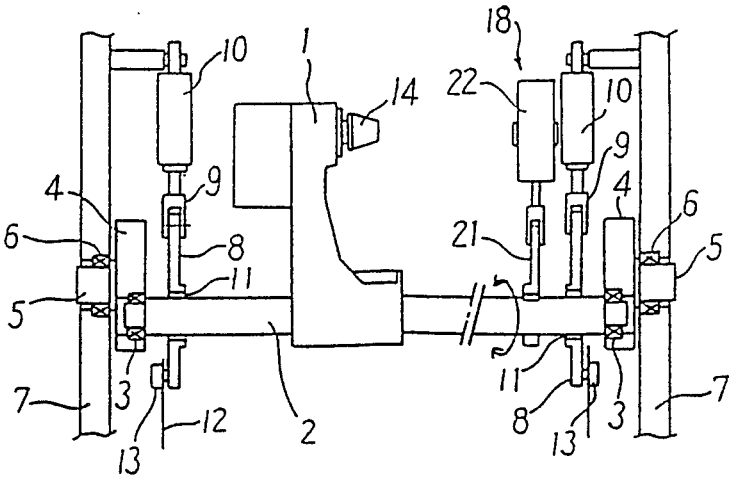
FIG. 2 is a front view of the same arm support portion.

As shown in FIG. 2, an arm shaft 2 serving as a center of rotation when arms 1 are raised or lowered, is supported via bearings 3, 3 at is opposite ends from eccentric plates 4, and shafts 5 of the same eccentric plates 4 are in turn pivotably supported via bearings 6 from frames 7. To the arm shaft 2 are pivotably mounted brackets 8, 8 on the left and right hands via bearings 11, 11, one end portion of the bracket 8 pivotably mounted to the arm shaft 2 is connected to a part of the frame 7 through a cylinder device that is swingably mounted to the frame 7 and consists of a piston member 9 and a cylinder 10, and to the other end portion of the bracket 8 is mounted a guide roll 13 which rolls in contact with the inside with a vertical guide channel 12 for guiding the other portion of the same bracket 8. The pair of left and right eccentric plates 4 are formed so as to operate jointly with each other via connecting means not shown. Accordingly, when the above-mentioned cylinder devices are actuated, the arm shaft 2 can move along a cylindrical surface having a radius equal to the eccentric radius of the eccentric plate 4 about the shaft 5 of the eccentric plate 4.

Figure 3:
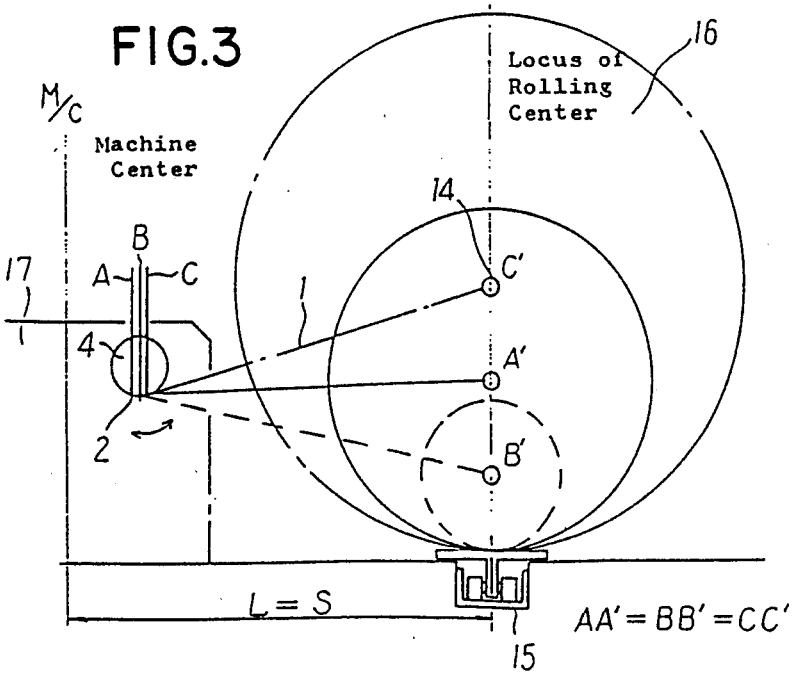
FIG. 3 is a schematic side view for explaining the function of the mill roll stand according to the present invention.

The function of the mill roll stand according to the present invention is clearly shown in FIG. 3. As shown in this figure, the deviation of the position of the rolling center 14 in the horizontal direction resulted from the arc-shaped locus inherent to the rolling center 14 is offset by moving the arm shaft 2 in the opposite direction to the deviation by means of the above-described mechanism, so that the rolling center 14 can be moved always along a vertical line passing through the center of the roller conveyor 15. It is to be noted that the movement of the arm shaft 2 corresponding to the arc-shaped locus of the rolling center 14 during the swinging of the arm 1, is effected jointly with the swinging motion according to a predetermined calculation formula as controlled by a control unit not shown.

By employing the above-described mechanism, it has become possible to unforcibly pinch the center of the rolled sheet 16 by the rolling centers 14 regardless of the diameter of the rolled sheet 16. It is also to be noted that the above-mentioned eccentric plate 4 could be replaced by an eccentric bearing that is omitted from illustration, and as means for rotating the bracket 8, besides the cylinder device various known systems could be employed.

The essence of the present invention resides in that upon ascent and descent of the arms 1 holding the rolled sheet 16 therebetween, the position of the arm shaft 2 serving as the center of the swinging of the arms 1 is variable, and owing to the means for varying the position of the arm shaft 2, the moving locus of the rolling center 14 at the tip end of the arm 1 can be preset on a vertical line passing through a center of a roller conveyor 15 serving as a carry-in means for the rolled sheet 16.

As described in detail above, in the mill roll stand according to the present invention, the rolling centers at the tip ends of the arms would not displace in the horizontal direction as a result of ascent and descent of the arms but the moving loci of the rolling centers can be preset on vertical lines which are always held at an equal horizontal distance from the center of the machine, therefore the rolling centers can be perfectly aligned with the center of core tube portion of a rolled sheet on a roller conveyor fixedly laid in the back and forth directions of the machine, and so, loading and unloading of the rolled sheet would become easy. As a result, damage of the paper sheet and the core tube of the rolled sheet and faults of the apparatus can be reduced to minimum, automation of the apparatus also becomes easy, and safe workability can be insured.

While a principle of the present invention has been described above in connection to one preferred embodiment of the invention, as a matter of course, many apparently widely different embodiments of the invention could be made without departing from the spirit of the invention.

What is claimed is:

1. A mill roll stand in a feeding apparatus of a rolled sheet, including at least one pair of arms having rolling centers at their tip ends and constructed so as to be swingable about an arm shaft at their base ends and so as to be movable along said arm shaft to approach to or separate from each other; characterized in that the opposite ends of said arm shaft are eccentrically and pivotably supported from rotary supports on a frame of said mill roll stand, and that there is provided converter means for converting the swinging locus of said rolling center into a locus along a vertical straight line, wherein said converter means includes a bracket mounted to said arm shaft, a cylinder device pivotably connected to one end of said bracket, and members for guiding the other end of said bracket in the vertical direction.

* * * * *